US007228863B2

(12) United States Patent
Dumler et al.

(10) Patent No.: US 7,228,863 B2
(45) Date of Patent: Jun. 12, 2007

(54) COMPACT

(75) Inventors: Norbert Dumler, Ansbach (DE); Steve Bennett, Lancaster (GB)

(73) Assignee: Geka Brush GmbH, Bechhofen (DE)

( * ) Notice: Subject to any disclaimer, the term of this patent is extended or adjusted under 35 U.S.C. 154(b) by 0 days.

(21) Appl. No.: 11/076,225

(22) Filed: Mar. 10, 2005

(65) Prior Publication Data

US 2005/0199259 A1 Sep. 15, 2005

(30) Foreign Application Priority Data

Mar. 10, 2004 (EP) ..... 04005690

(51) Int. Cl.
*A45D 33/24* (2006.01)
*A45D 33/26* (2006.01)

(52) U.S. Cl. ..... 132/294

(58) Field of Classification Search ..... 132/293–300, 132/314, 218; 206/581, 823; D28/83; 220/23.4, 220/23.86
See application file for complete search history.

(56) References Cited

U.S. PATENT DOCUMENTS 4,369,799 A * 1/1983 Napoleon ..... 132/294
4,898,195 A * 2/1990 Sussman ..... 132/317
5,004,106 A * 4/1991 Blumstock et al. ..... 206/581
5,052,839 A 10/1991 Pettengill
5,713,471 A * 2/1998 Gueret ..... 206/581
D404,532 S * 1/1999 Castagna ..... D28/77
6,073,634 A * 6/2000 Gueret ..... 132/218
6,412,640 B1 * 7/2002 Destanque et al. ..... 206/581
2003/0034044 A1 * 2/2003 Gubernick ..... 132/294
2003/0154996 A1 8/2003 Bourjal

* cited by examiner

*Primary Examiner*—Robyn Doan
(74) *Attorney, Agent, or Firm*—Browdy and Neimark, PLLC

(57) ABSTRACT

In a compact comprising a housing, an applicator and a plurality of recesses in the housing for receiving a cosmetic, it is provided, with a view to obtaining an improved compact, that the length of the applicator and the width of the recesses are coordinated for the sum of the widths of the recesses approximately to correspond to the length of the applicator so that the applicator, when stroking across the recesses, is simultaneously loaded with each of the cosmetics contained therein.

14 Claims, 1 Drawing Sheet

COMPACT

BACKGROUND OF THE INVENTION

1. Field of the Invention

The present invention relates to a compact, comprising a housing, an applicator and a plurality of recesses in the housing for receiving a cosmetic.

2. Background Art

A cosmetic is a preparation which is applied externally to the human body for the purpose of preserving, beautifying or altering the appearance of a person to whom the cosmetic is applied. Common cosmetics include lipstick, face powder and eye shadow.

Another common cosmetic is mascara, which is applied to eye lashes, typically to colour or darken them. It is also known to apply mascara to hair to give an altered visual appearance. Most commonly, mascara is applied in liquid form from a tubular plastics housing in which the mascara is stored. The plastics housing has a closed end and a removable cap threadingly received on the other end. An applicator is provided on the cap, in the form of an elongate member having a brush at its free end, which extends away from the cap and is stored within the housing when the cap is in position on the housing. The elongate member extends substantially the whole length of the housing, to enable the brush to be at least partially immersible in any mascara contained within the housing when the applicator is inserted into the housing.

To colour or darken eye lashes using the liquid mascara, the applicator is agitated within the housing to ensure an amount of mascara is loaded on the brush. The applicator is then removed from within the housing, and the brush bearing the mascara is applied in strokes to the underside or top, or both, of the eye lashes of one eye at a time, thereby transferring mascara to the eye lashes.

It is also known to provide mascara in a solid form, contained in a plastics housing, the combination of the housing and solid mascara being commonly referred to as a "compact". Typically, an applicator brush is also provided with the compact, for application of the mascara. To apply the mascara, either the brush or the surface of the solid mascara is first moistened, using saliva for example. The brush is then brought into contact with the solid mascara, to transfer an amount of the mascara to the brush, which is then applied to the eyelashes in the mariner described above.

SUMMARY OF THE INVENTION

It is an object of the invention to provide an improved compact. According to the broadest aspect of the present invention, this object is attained in a compact by the length of the applicator and the width of the recesses being coordinated for the sum of the widths of the recesses approximately to correspond to the length of the applicator so that the applicator, when stroking across the recesses, is simultaneously loaded with each of the cosmetics contained therein.

Preferably, the recesses are aligned with one another to form a column of recesses.

Conveniently, an applicator having a brush at one end is removably stored within the housing, for transferring the cosmetics received in the recesses, for the purpose of preserving, beautifying or altering the external appearance of a person.

In a preferred embodiment, the compact is stylised externally to correspond generally to the shape of an eye.

According to a further aspect of the invention, there is provided a method for applying cosmetics to hair comprising the steps of providing a compact, the compact consisting of a housing having a plurality of recesses, in which at least some of the recesses include cosmetics of different visual appearance; bringing a surface of an applicator into simultaneous contact with the cosmetics, to load an amount of the cosmetics on to the applicator; and transferring an amount of the cosmetics from the applicator to a person's hair, for the purpose of preserving, beautifying or altering the external appearance of the person.

The invention will now be described, by way of example only, with reference to the accompanying drawings.

DESCRIPTION OF THE PREFERRED EMBODIMENT

Figure 1:
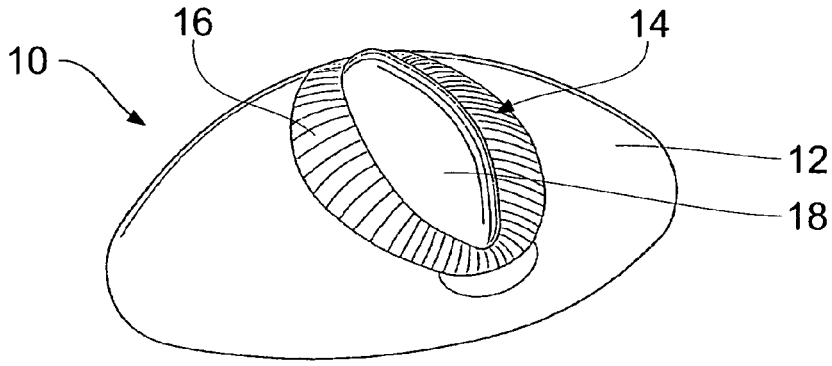
FIG. 1 is a perspective view of a compact according to a preferred embodiment of the invention with the compact lid in a closed position.

Referring to FIG. 1, a compact is indicated generally at 10. The compact 10 is in the form of a plastics moulding and consists of a housing 12 including a hingeably displaceable lid 14 releasably retained in a closed position (as shown) by means of a locking recess (not shown, and described in more detail with reference to FIG. 2).

The compact 10 is stylised externally to correspond generally to the shape of an eye, when viewed in a mirror, for example. The housing 12 is in the form of a domed ellipsoid, corresponding generally to the visible part an eye ball, and the lid 14 is generally circular, having an iris portion 16 and an elliptical pupil portion 18.

Figure 2:
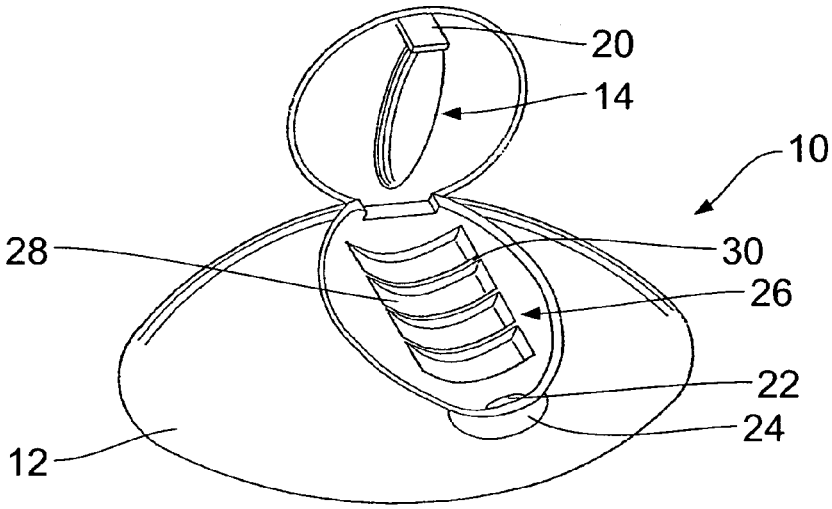
FIG. 2 is a view similar to FIG. 1 with the lid in an open position, showing recesses for a cosmetic or cosmetics.

FIG. 2 shows the compact 10 in an open position in which the lid 14 has been hingeably displaced from the position shown in FIG. 1. The lid 14 includes a projection 20 having a nib (not shown) along its lower end for snap-fit engagement with the locking recess, indicated at 22, to releasably retain the lid 14 in the closed position shown in FIG. 1. The housing 12 has a concave formation 24 in the region adjacent the locking recess 22, which is shaped to allow a fingernail, for example, to engage the underside of the lid 14 when in the closed position of FIG. 1. Hence, when it is desired to release the lid 14, upward force is applied to the underside of the lid 14 to overcome the snap-fit engagement between the nib (not shown) and the locking recess 22, thereby enabling the lid to be moved to the open position shown.

The housing 12 includes a concave portion 26, which corresponds in plan view to the area covered by the lid 14 when in the closed position. The concave portion 26 includes a plurality of rectangular recesses, four in this embodiment, one of which is indicated at 28, each for receiving a cosmetic, e.g. a solid mascara preparation. The recesses 28 are arranged in a consecutively aligned column on the concave portion 26, each of the recesses 28 being in alignment with one another, and separated from one another by lands 30; each of the recesses 28 are formed curved concave along the longitudinal length of each of the recesses.

Figure 3:
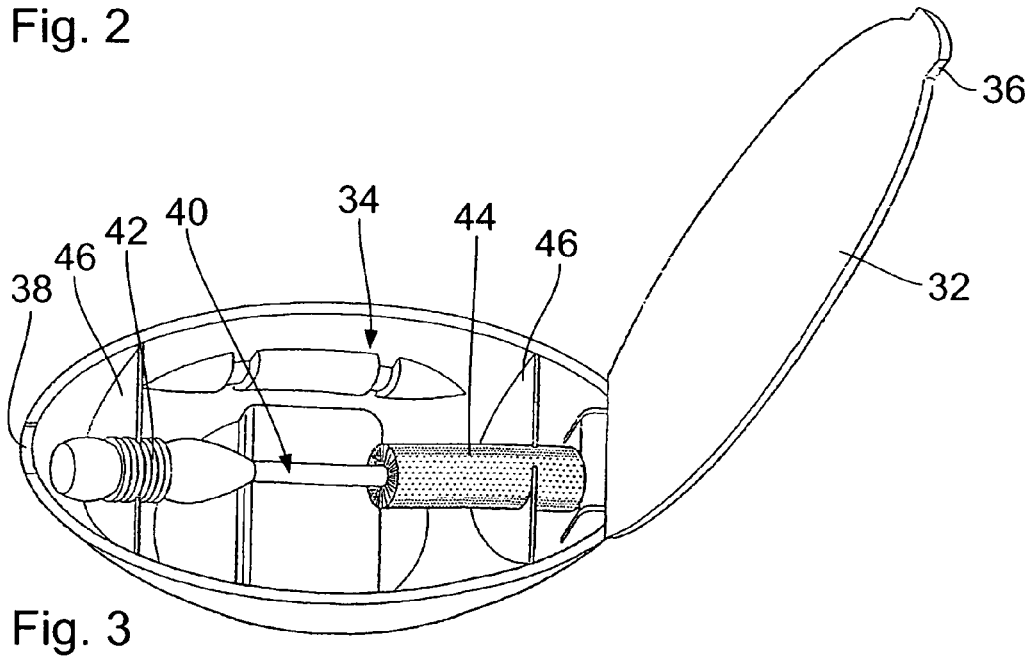
FIG. 3 is a perspective view from below of the compact of FIG. 1 with an underside cover in an open position to reveal a cosmetics applicator.

The base of the housing 12 consists of a planar lower surface, including a hingeably displaceable cover 32 for a compartment 34 contained within the housing 12, as can be seen in FIG. 3. The cover 32 is movable between a closed position and open position (as shown in FIG. 3), and has a nib 36 adapted for snap-fit engagement with a locking aperture 38 on the periphery of the base of the housing 12, by means of which the cover 32 is releasably retainable in the closed position (not illustrated). To release the cover 32 from the closed position, the nib 36 is engaged by a fingernail, for example, and force is applied to the nib 36 in a direction downwardly away from the housing 12, to overcome the snap-fit engagement with the locking applicator 40; both brush and handle having a circular cross section.

A cosmetics applicator 40 having a handle 42 and a brush 44 is removably stored in the compartment 34, by means of locating plates 46 which are adapted to removably receive the handle 42 and brush 44 of the cosmetics applicator 40.

Use of the compact 10 in colouring a person's eye lashes will now be described, by way of example, in which an individual colour of solid mascara preparation is received in each of the recesses 28, respectively (not shown).

Firstly, the cover 32 is moved from the closed position (not shown) to the open position of FIG. 3. The cosmetics applicator 40 is then removed from its stored position in the housing 12 and the cover 32 is then re-closed. The lid 14 is opened and moisture, for example saliva, is applied to either the brush 44 or the surface of each of the individual mascara preparations. The brush 44 corresponds in length to the height of the consecutively aligned column of recesses 28 containing the individual solid mascara preparations. Hence, by aligning the extremities of the brush 44 with the extremities of the consecutively aligned column of recesses 28, and by stroking the brush 44 forcibly across the surface of the column of mascara preparations, left to right as viewed, four individually coloured bands of mascara are loaded on to the surface of the brush 44. The brush 44 is then be applied in a conventional manner to a person's eye lashes, one eye at a time, whereby an amount of each of the four colours of mascara loaded on the brush 44 is transferred individually on to the eye lashes, thereby creating a multi-coloured cosmetic effect on the person's eye lashes.

The pupil portion 18 of the lid 14 is transparent, so that the mascara preparations received on the housing 12 are visible when the lid 14 is in the closed position shown in FIG. 1.

What is claimed is:

1. A compact comprising:

a housing (12);

an applicator (40) having a brush (44) in the housing (12); and a plurality of recesses (28) in the housing (12), each of the recesses (28) having a cosmetic therein;

wherein the recesses (28) are arranged in the housing (12) side-by-side along the longitudinal length of each of the recesses (28);

wherein the length of the brush (44) is substantially equal to a width of the plurality of recesses (28) defined by the distance between a first and a last longitudinal edge of the plurality of recesses;

wherein when opposite ends of the brush (44) are respectively aligned with the first and the last longitudinal edge of the plurality of recesses and moved across the plurality of recesses, the brush is loaded in a single stroke with each of the cosmetics in the plurality of recesses, wherein the recesses (28) are each formed in a concave portion (26) of the housing (12) and are each themselves formed curved concave along the longitudinal length thereof, wherein the applicator is a mascara brush having a brush and a handle engaged to the brush, and wherein both the brush and handle have a circular cross section.

2. The compact according to claim 1, wherein each of the recesses (28) are consecutively aligned along the width of the recesses.

3. The compact according to claim 1, wherein each of the recesses (28) have an approximately rectangular basic shape.

4. The compact according to claim 1, wherein the plurality of recesses (28) are formed in the concave portion (26) of a first compartment of the housing (12).

5. The compact according to claim 4, wherein the plurality of recesses (28) are covered by a lid (14) over the first compartment.

6. The compact according to claim 5, wherein the lid (14) includes a projection (20) having a nib for leakage or drying to be precluded.

7. The compact according to claim 4, wherein the applicator (40) is removably stored in a second compartment (34) of the housing (12) located below a bottom side of the first compartment.

8. The compact according to claim 7, wherein the second compartment (34) that stores the applicator (40) is closed by a cover (32).

9. The compact according to claim 7, wherein the longitudinal length of the first compartment is longer than and traverse to that of the second compartment.

10. The compact according to claim 7, wherein the longitudinal length of the first compartment is greater than the width of the second compartment.

11. The compact according to claim 1, wherein the applicator is a twisted or injected mascara brush.

12. The compact according to claim 1, wherein the cosmetic is a viscous, cast cosmetic or a powdery compacted cosmetic for grooming or for colouring.

13. The compact according to claim 1, wherein the cosmetic in each of the recesses has a color different from the other recesses.

14. The compact according to claim 1, wherein the longitudinal length of each of the plurality of recesses extend along the longitudinal length of the housing.

* * * * *